US008756883B2

(12) United States Patent
Glass et al.

(10) Patent No.: US 8,756,883 B2
(45) Date of Patent: Jun. 24, 2014

(54) ASSEMBLY AND METHOD FOR SECURING A DOOR OPENING OR OTHER OPENING OF A BUILDING STRUCTURE

(71) Applicant: Door & Window Guard Systems, Inc., Inverness, IL (US)

(72) Inventors: James D. Glass, Inverness, IL (US); William F. Laubach, Inverness, IL (US)

(73) Assignee: Door & Window Guard Systems, Inc., Inverness, IL (US)

( * ) Notice: Subject to any disclaimer, the term of this patent is extended or adjusted under 35 U.S.C. 154(b) by 15 days.

(21) Appl. No.: 13/661,681

(22) Filed: Oct. 26, 2012

(65) Prior Publication Data

US 2013/0111833 A1 May 9, 2013

Related U.S. Application Data

(63) Continuation-in-part of application No. 13/290,595, filed on Nov. 7, 2011, now Pat. No. 8,656,664.

(51) Int. Cl.
*E06B 5/11* (2006.01)

(52) U.S. Cl.
USPC ..... 52/202; 49/57; 49/170; 52/745.16

(58) Field of Classification Search
USPC ..... 52/202, 203, 745.15, 745.16; 49/50, 57, 49/163, 169, 170
See application file for complete search history.

(56) References Cited

U.S. PATENT DOCUMENTS

| | | | | |
|---|---|---|---|---|
| 1,788,928 | A * | 1/1931 | Mills | 49/50 |
| 2,549,661 | A | 4/1951 | Carney | |
| 2,611,933 | A * | 9/1952 | Comfort | 52/207 |
| 2,622,285 | A | 12/1952 | Roos | |
| 2,772,447 | A | 12/1956 | Preston | |
| 3,120,032 | A * | 2/1964 | Burnette | 49/395 |
| 3,978,614 | A * | 9/1976 | Goldhaber | 49/55 |
| 4,098,025 | A * | 7/1978 | Stock et al. | 49/388 |
| 4,175,357 | A * | 11/1979 | Goldhaber | 49/395 |
| 4,520,736 | A * | 6/1985 | Crosby et al. | 109/60 |

(Continued)

FOREIGN PATENT DOCUMENTS

| | | |
|---|---|---|
| GB | 2160248 | 12/1985 |
| GB | 2270336 | 3/1994 |
| GB | 2277548 | 11/1994 |

OTHER PUBLICATIONS

Brochure, "National Arson Prevention Initiative board up procedures," U.S. Fire Administration (2003).

*Primary Examiner* — Brent W Herring
(74) *Attorney, Agent, or Firm* — Barnes & Thornburg LLP

(57) ABSTRACT

An assembly and method for securely enclosing a door opening defined by a building structure comprising: a frame disposed about the opening engaging one side of the structure; a door or other panel substantially covering the opening, the panel being pivotally secured to the frame and pivotable between an open position and a closed position; an installation bar engageable with the frame to secure the frame to the structure such that the frame and the panel are disposed substantially on one side of the structure and the frame engages the one side of the structure, and the installation bar is disposed substantially on an other side of the structure and engages the other side of the structure, the length of the installation bar exceeding a dimension of the opening; and locking means for selectively locking the panel to the frame in the closed position and for unlocking the door.

25 Claims, 10 Drawing Sheets

(56) References Cited

U.S. PATENT DOCUMENTS

| | | | | | |
|---|---|---|---|---|---|
| 4,938,154 | A | | 7/1990 | Watt | |
| 5,207,022 | A | | 5/1993 | Watt | |
| 5,289,655 | A | * | 3/1994 | Marmora et al. | 49/141 |
| 5,335,452 | A | | 8/1994 | Taylor | |
| 5,365,706 | A | * | 11/1994 | Elsenpeter et al. | 52/204.1 |
| 5,487,237 | A | * | 1/1996 | Martin, Jr. | 49/57 |
| 5,683,123 | A | | 11/1997 | Ruoss | |
| 5,722,206 | A | | 3/1998 | McDonald | |
| 5,737,874 | A | * | 4/1998 | Sipos et al. | 49/67 |
| 5,832,671 | A | | 11/1998 | White | |
| 5,832,758 | A | | 11/1998 | White | |
| 5,852,903 | A | * | 12/1998 | Astrizky | 52/202 |
| 5,937,593 | A | | 8/1999 | White | |
| 6,115,977 | A | | 9/2000 | Hornberger | |
| 6,205,713 | B1 | | 3/2001 | Thompson | |
| 6,216,391 | B1 | * | 4/2001 | Garrett, Jr. | 49/141 |
| 6,345,476 | B1 | * | 2/2002 | Hill | 52/202 |
| 6,510,654 | B1 | * | 1/2003 | McCracken | 49/67 |
| 7,650,723 | B1 | * | 1/2010 | Kotlarich | 52/202 |
| 7,775,002 | B2 | | 8/2010 | Puchniak | |
| 7,908,803 | B2 | | 3/2011 | Puchniak | |
| 8,046,967 | B2 | | 11/2011 | Suare | |
| 8,490,346 | B2 | * | 7/2013 | Wedren | 52/202 |
| 8,656,642 | B2 | * | 2/2014 | Boens | 49/170 |
| 2004/0055218 | A1 | * | 3/2004 | Forsyth et al. | 49/54 |
| 2009/0090062 | A1 | * | 4/2009 | Pandorf | 49/50 |
| 2011/0107692 | A1 | * | 5/2011 | Duncan | 52/202 |

* cited by examiner

ASSEMBLY AND METHOD FOR SECURING A DOOR OPENING OR OTHER OPENING OF A BUILDING STRUCTURE

CROSS REFERENCE TO RELATED APPLICATIONS

This Application is a continuation-in-part application of U.S. patent application Ser. No. 13/290,595 filed Nov. 7, 2011.

BACKGROUND

The present disclosure relates to an assembly and method for securing a door opening or other opening of a building.

Abandoned, vacant, fire damaged, or buildings undergoing rehab are often targets for trespassers and for criminal or dangerous activity because, among other reasons, such structures typically include doors and windows which allow ready entry and egress into the structures. It typically is difficult, if not impossible, to adequately secure the doors and windows or to otherwise keep trespassers from being readily able to break and enter into such structure through the doors or windows using wood, dogs or guards. Not only can criminal or other dangerous activity of trespassers detrimentally impact the value of the property, it also creates significant liability risks to the property owners and public safety personnel and causes a drain on public safety personnel through the need to patrol, nuisance calls, and fires.

A common way to secure the doors and windows of abandoned or vacant homes is by securing wooden boards to the doors and windows. Such securing efforts have inherent disadvantages. For example, the removal of one or more of the wood screws from one opening may be sufficient to unsecure the entire building. Further, as time passes, the wooden boards and the hardware or securing means becomes weather beaten. Further, such securing efforts tend to result in neighborhood "eyesores" as the wooden boards lack aesthetics.

The economic down turns of the last decade in conjunction with the collapse of the real estate market has created thousands, if not hundred of thousands, of abandoned or vacant houses, dwellings, commercial buildings or other structures that are unsecured from criminal removal of items therein, including appliances, windows, furnaces, copper pipe, copper tube, copper wire, etc. Additionally, because such structures typically become abandoned or vacated due to poor economic circumstances, it follows that the funds available to secure or protect such abandoned or vacant structures from trespassers and criminal activity typically are substantially limited.

SUMMARY

The present disclosure is directed to an assembly for securely enclosing a door opening or other opening defined by a wall or other structure of a house or other building. The assembly comprises a frame sized to be disposed substantially about the opening and engage one side of the structure; a door or other panel sized to substantially cover the opening, the panel having a front and a back, the panel being pivotally secured to the frame and pivotable between an open position and a closed position; one or more installation bars engageable with the frame to secure the frame to the structure such that the frame and the panel are disposed substantially on one side of the structure and the frame engages the one side of the structure, and the installation bar is disposed substantially on an other side of the structure and engages the other side of the structure; and a locking means for selectively locking the panel to the frame in the closed position and for unlocking the door.

The locking means may comprise a mechanical locking system comprising a plurality of latch bolts and a cam operatively connected to the latch bolts. The locking means may also include a manual lock on the front of the door to lock the mechanical locking system so that the mechanical locking system cannot be activated from the one side of the structure when the manual lock is locked. The mechanical locking system may be activatable from either side of the door. The mechanical locking system may include a lockport disposed on the front of the door. The lockport in accordance with an embodiment provides additional structural locking strength and also limits access to the mechanical locking system. The assembly may also comprise a shroud disposed on the front of the panel to limit access to the mechanical locking system.

The assembly may include a plurality of strips secured to the door and a plurality of strips secured to the frame to cover openings that otherwise provide areas that trespassers can use to try to pry the door or frame. Two such strips, for example, can be secured on the front of the door to prevent access to hinge pins secured to the door and engaged with the frame.

The present disclosure is also directed to a method for installing the panel to the structure of the building to securely enclose the door opening or other opening defined by the structure of the building. The method includes positioning on the one side of the structure the frame and the door; securing the one or more installation bars to the frame with a rod received by a slot defined by the installation bar and a hole defined by the frame so that the door is on the one side of the structure and the installation bar is on an other side of the structure; moving the installation bar toward the frame until the frame engages the one side of the structure and installation bar engages the other side of the structure and the structure is engaged by and between the frame and the installation bar to substantially enclose the opening; and locking the door to the frame to secure the door in the closed position.

Features and advantages of the disclosure will be set forth in part in the description which follows and the accompanying drawings described below, wherein one or more embodiments of the disclosure is described and shown, and in part will become apparent upon examination of the following detailed description taken in conjunction with the accompanying drawings.

BRIEF DESCRIPTION OF THE DRAWINGS

The present disclosure and the advantages thereof will become more apparent upon consideration of the following detailed description when taken in conjunction with the accompanying drawings.

DETAILED DESCRIPTION

Figure 1:
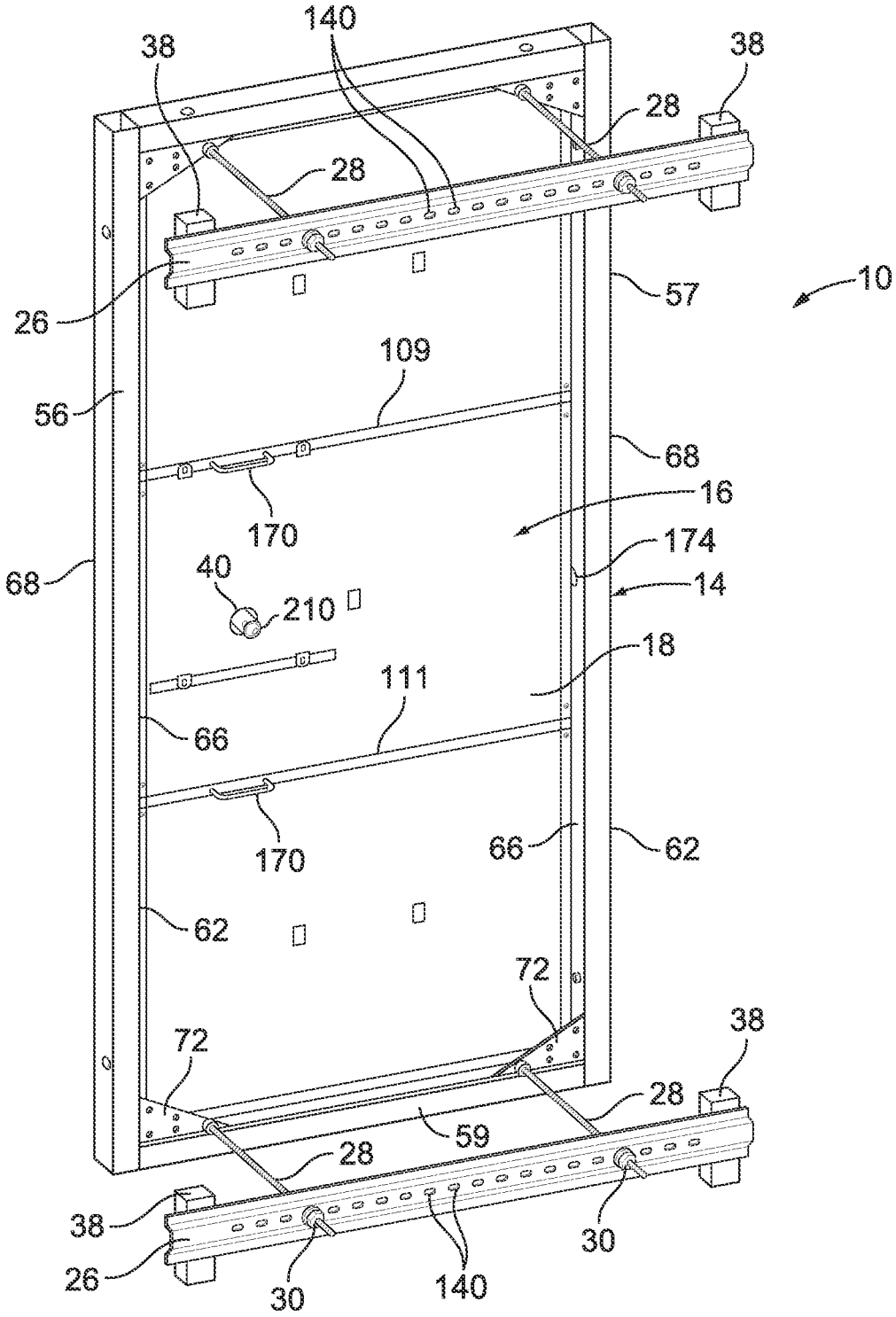
FIG. 1 is a back view of an assembly in accordance with an illustrated embodiment of the present disclosure.
Figure 2:
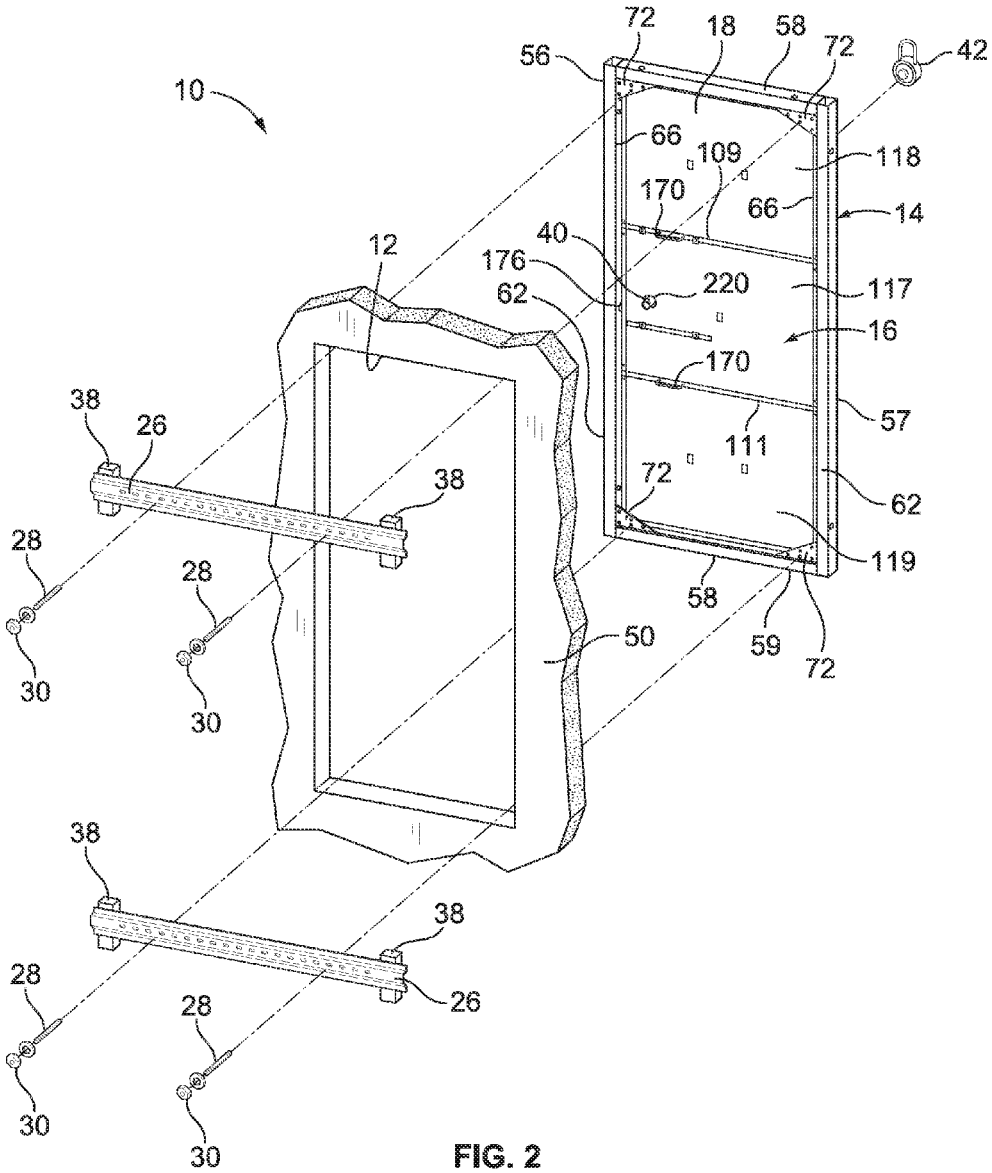
FIG. 2 is an exploded view of the assembly of FIG. 1 also illustrating a door opening to be enclosed by the assembly.
Figure 4:
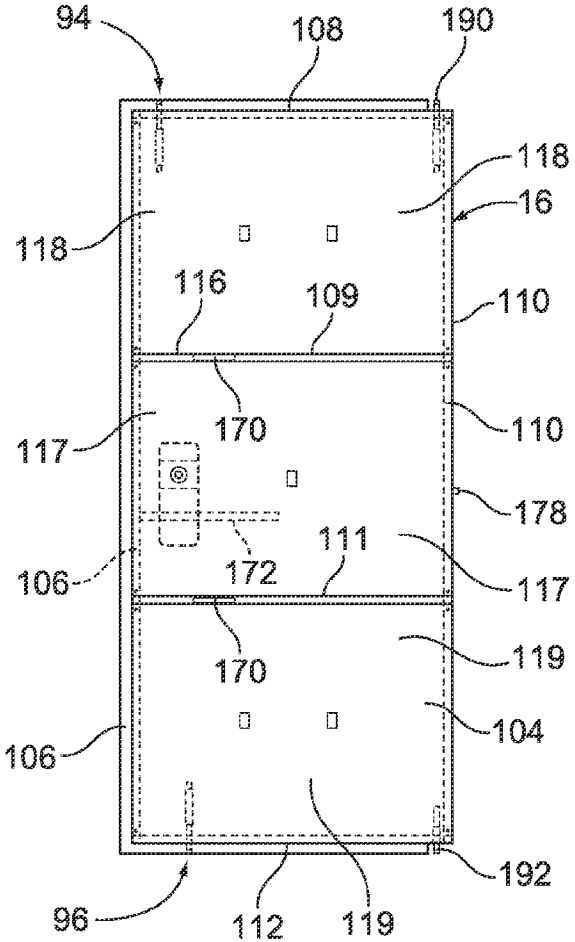
FIG. 4 is a plan view of the back of the door assembly of the assembly of FIG. 1.
Figure 3:
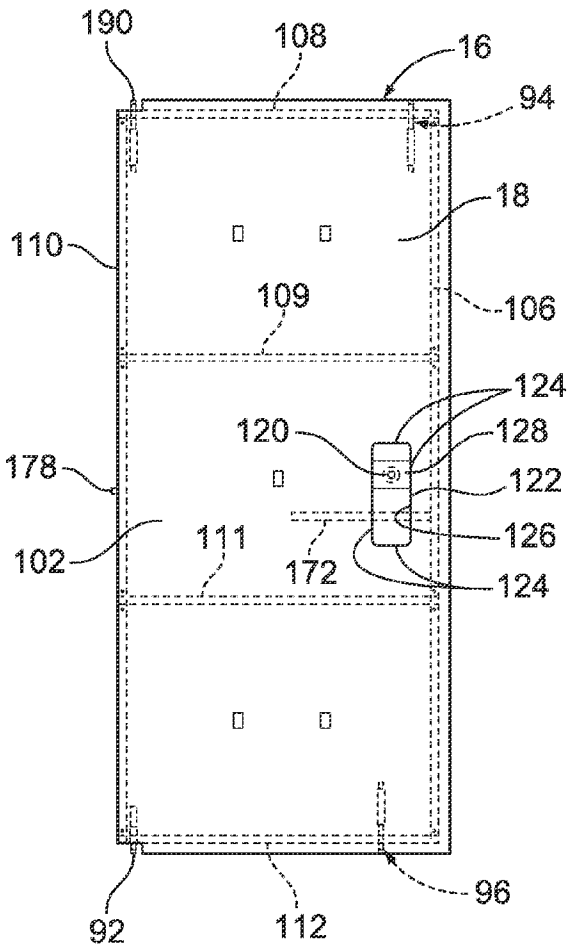
FIG. 3 is a plan view of the front of the door assembly of the assembly of FIG. 1.
Figure 6:
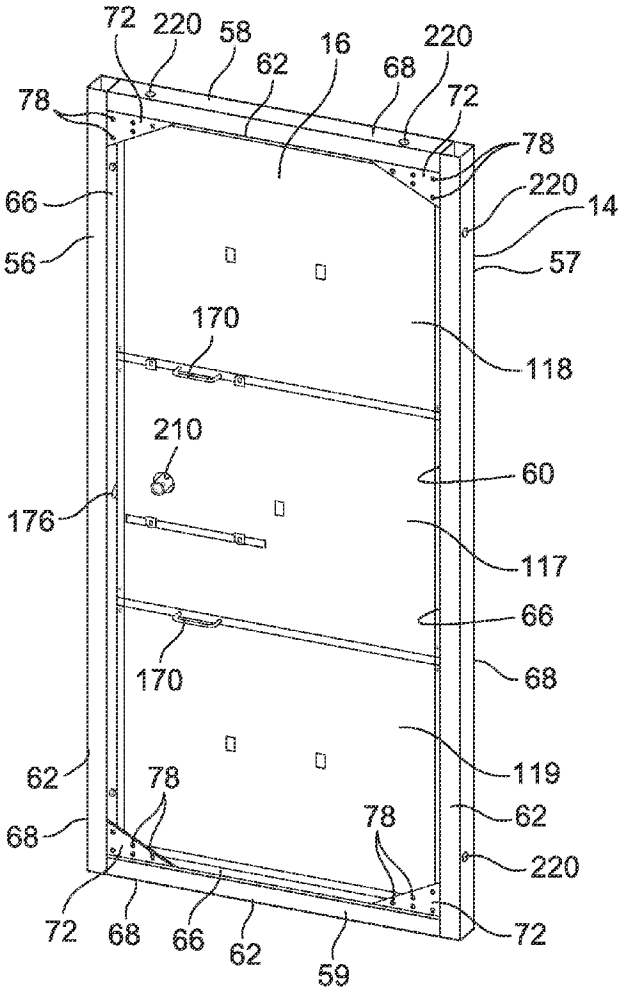
FIG. 6 is a plan view of the back of the door assembly and the frame assembly illustrating the door of the door assembly locked to the frame assembly in the closed position.
Figure 5:
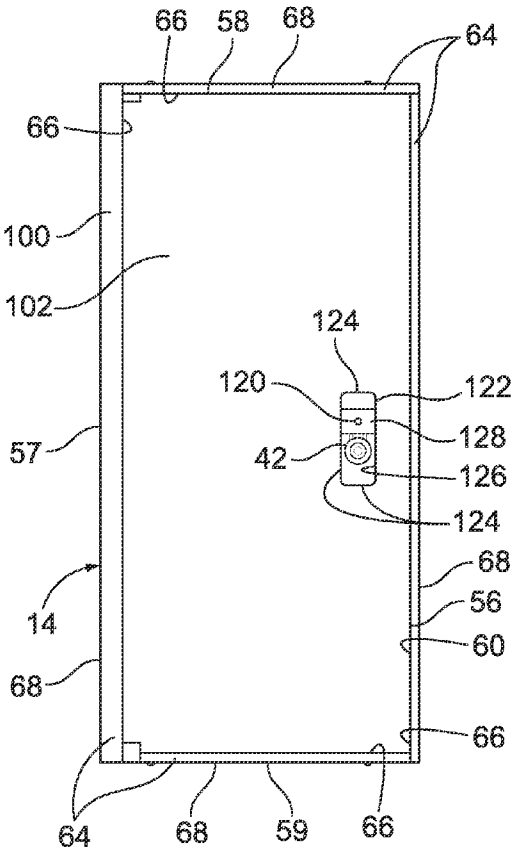
FIG. 5 is a plan view of the front of the door assembly and the frame assembly illustrating the door of the door assembly locked to the frame assembly in the closed position.
Figure 9:
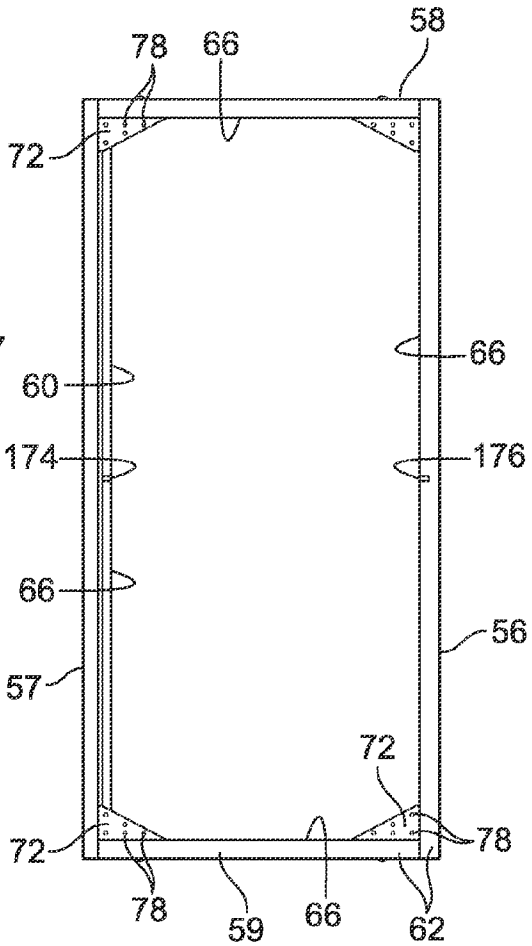
FIG. 9 is a plan view of the back of the frame of the assembly of FIG. 1.
Figure 8:
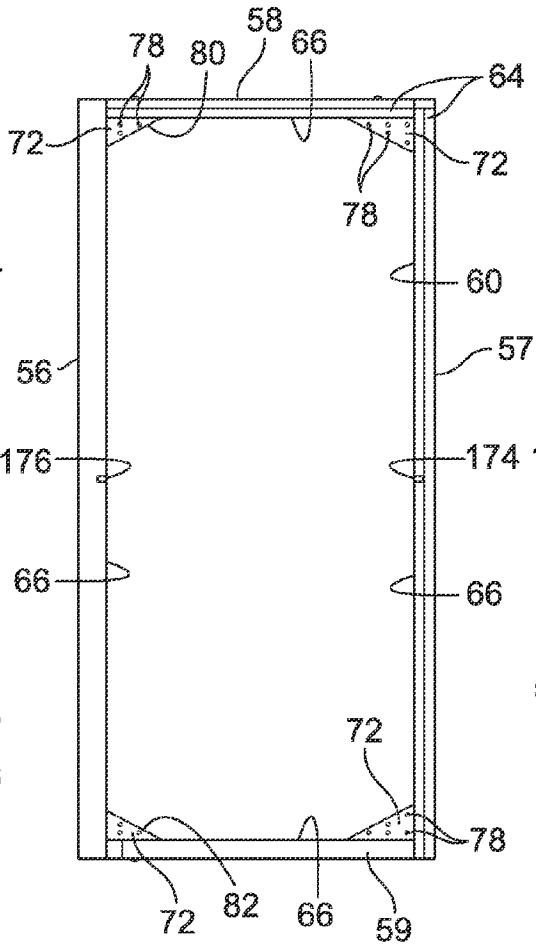
FIG. 8 is a plan view of the front of the frame of the assembly of FIG. 1.
Figure 7:
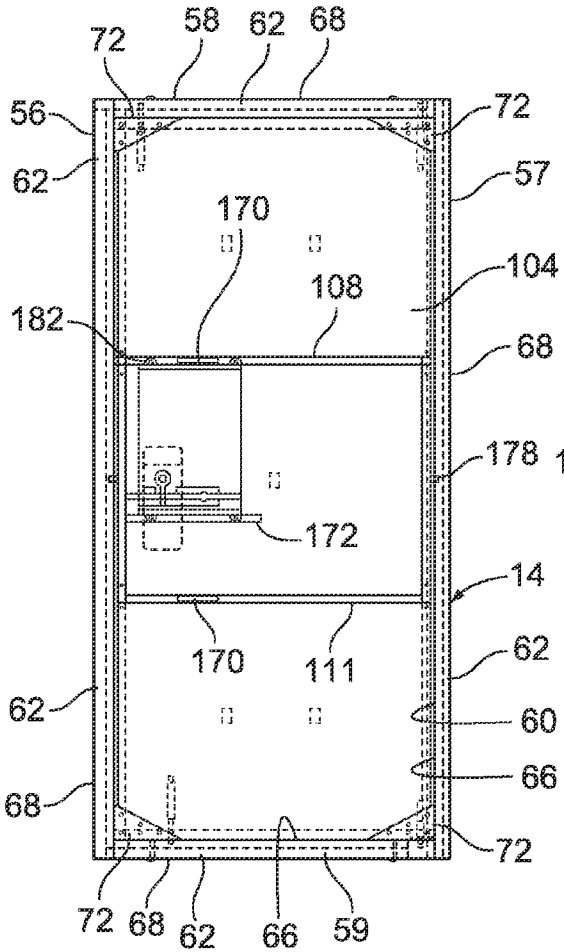
FIG. 7 is a plan view of the back of the door assembly and the frame assembly illustrating the door of the door assembly locked to the frame assembly in the closed position, illustrating the back panels of the door assembly removed.
Figure 10:
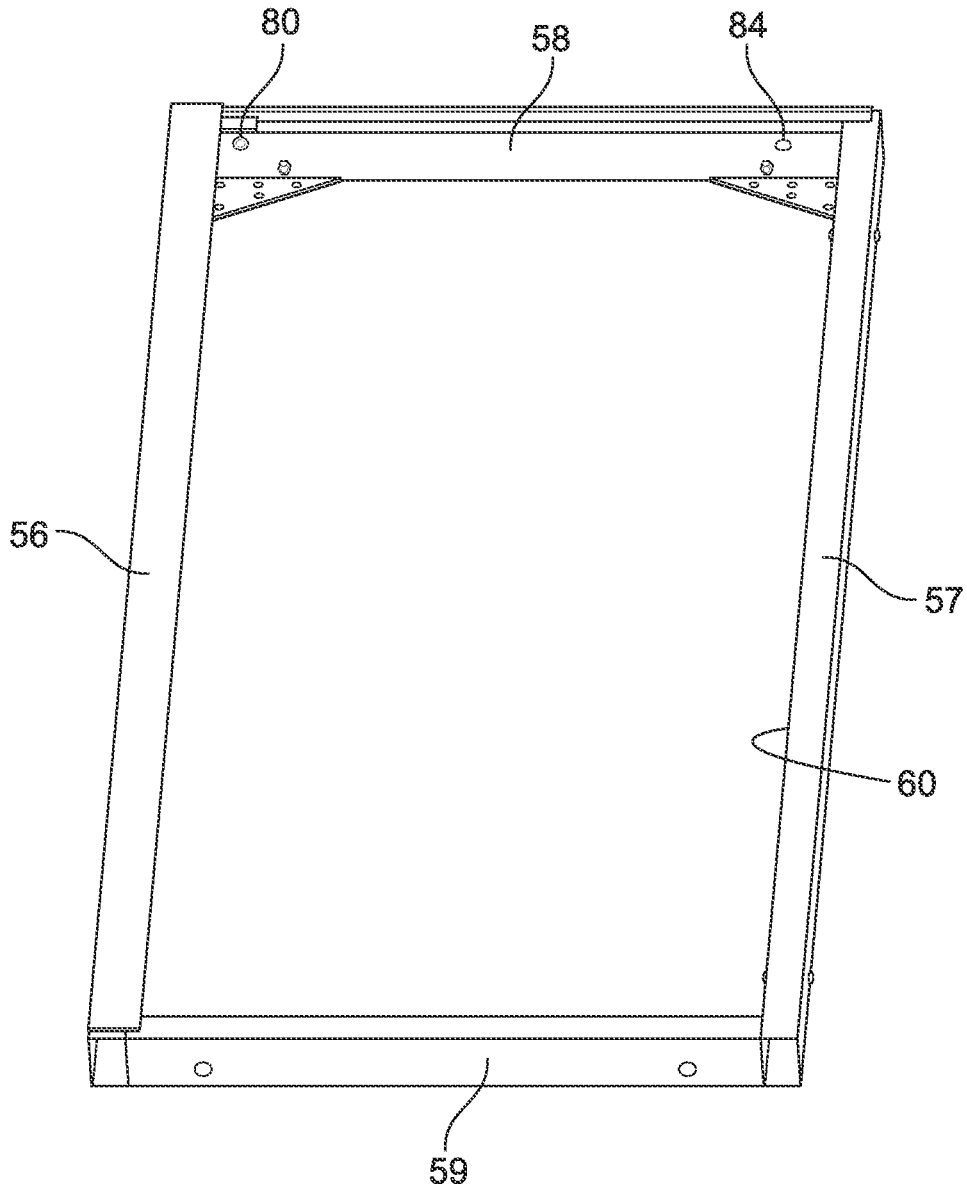
FIG. 10 is a front partially rotated view of the frame assembly of the assembly of FIG. 1.
Figure 11:
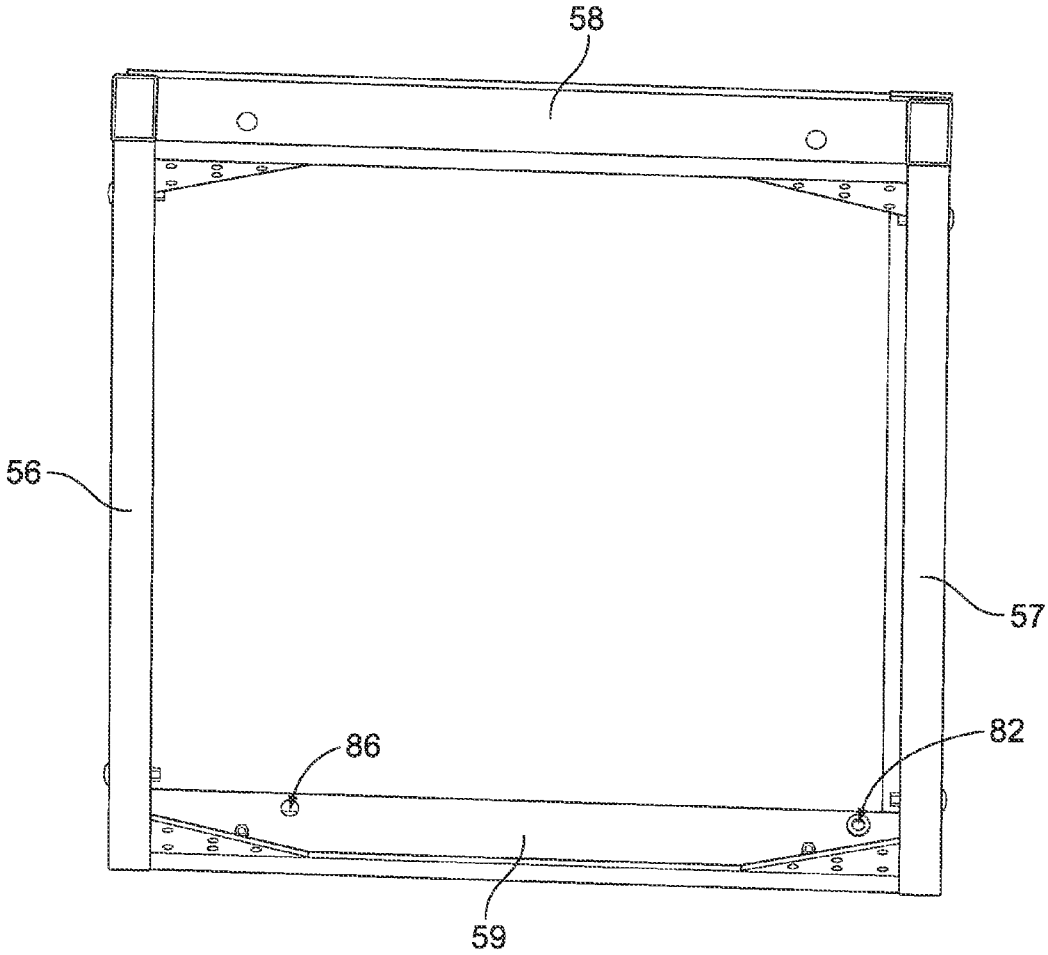
FIG. 11 is a rear partially rotated view of the assembly of FIG. 1.
Figure 12:
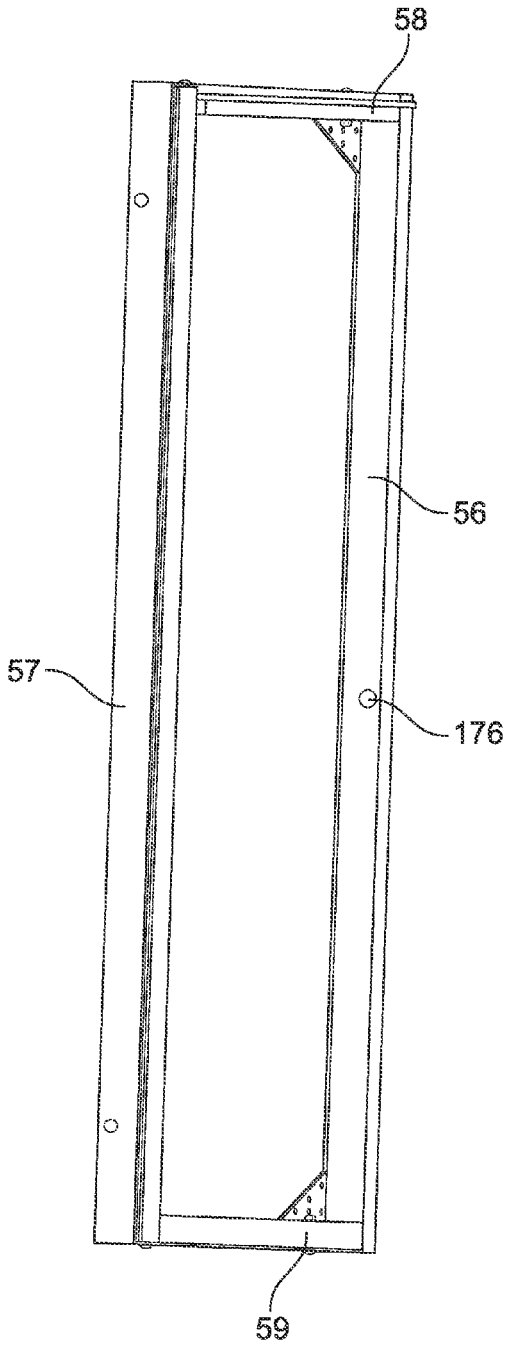
FIG. 12 is an other front partially rotated view of the frame assembly of the assembly of FIG. 1.
Figure 13:
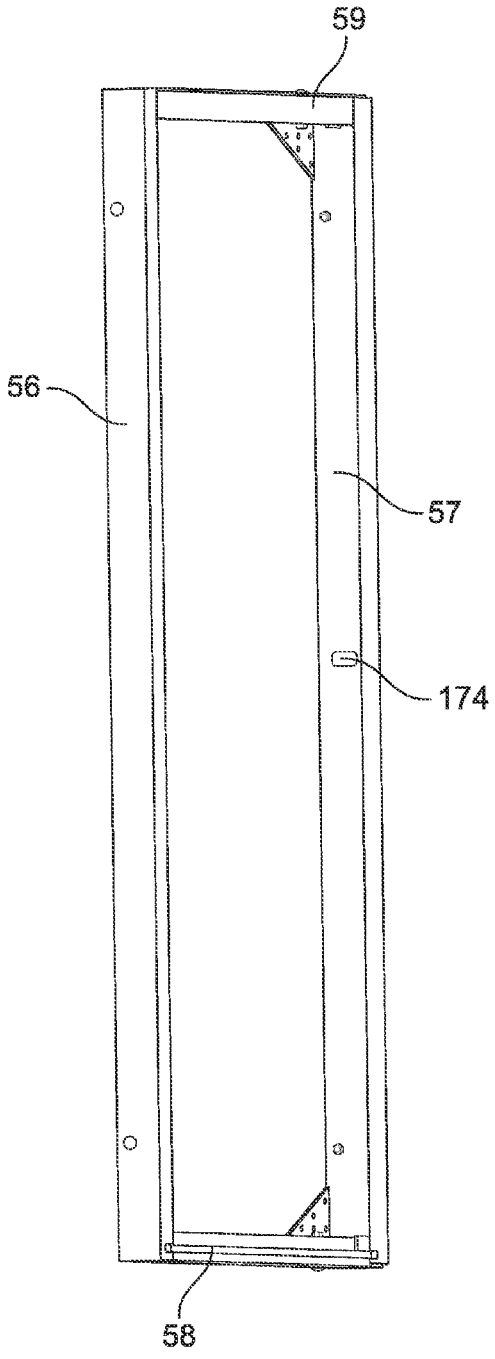
FIG. 13 is an other front partially rotated view of the frame assembly of the assembly of FIG. 1 also shown rotated upside down for illustrative purposes.
Figure 14:
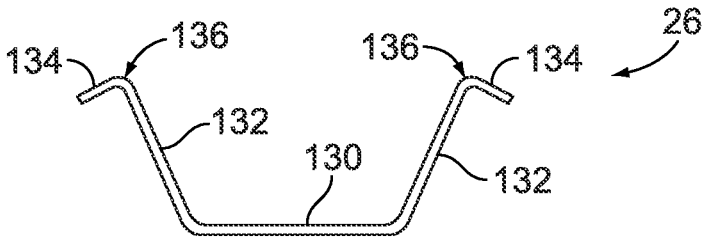
FIG. 14 is a plan view of one end of the installation bar of the assembly of FIG. 1.
Figure 15:
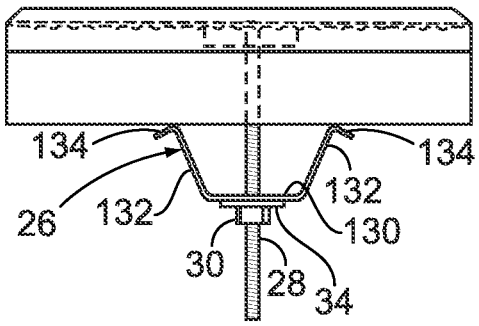
FIG. 15 is a partial end view of installation bar and frame assembly of the assembly of FIG. 1 (except omitting one of the pads of the assembly)
Figure 16:
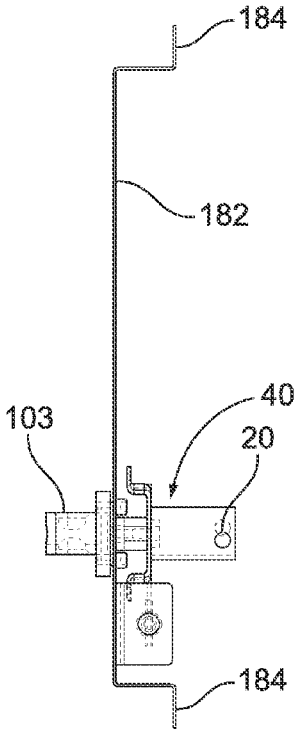
FIG. 16 is a side plan view of the mechanical locking system in accordance with an embodiment of the invention with the wires removed for illustrative purposes and a mounting plate for securing the mechanical locking system to the door assembly of the assembly of FIG. 1.
Figure 17:
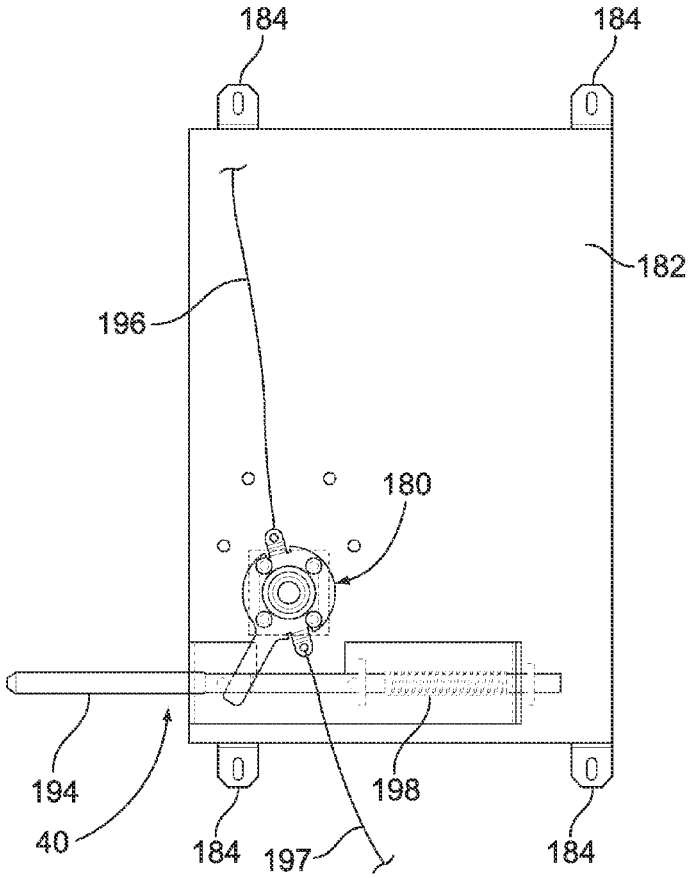
FIG. 17 is a rear plan view of the mechanical locking system in accordance with an embodiment of the invention and the mounting plate for securing the mechanical locking system to the door assembly of the assembly of FIG. 1.

FIGS. 1-17 illustrate an assembly 10 for enclosing a door opening 12 of a house. The assembly 10 comprises generally a frame assembly 14, a door assembly 16 including a door 18 pivotally secured to the frame assembly, a pair of installation bars 26, a plurality of threaded rods 28, a plurality of nuts 30, two pairs of pads 38, and locking means comprising a mechanical locking system 40 and a manual lock 42. The illustrated assembly 10 may be used to secure the frame assembly 14 and door assembly 16 to a wall 50 or other structure of the house over the door opening 12 to enclose and secure the door opening to prevent or substantially reduce the ability of a trespasser to enter the house through the door opening. In the illustrated embodiment, the frame assembly 14 and door assembly 16 are disposed outside the house and the installation bars 26 are disposed inside the house to secure the frame assembly and the door assembly to the wall 50.

The frame assembly 14 in accordance with an illustrated embodiment of the present disclosure comprises a pair of parallel vertical members 56 and 57 and a pair of parallel horizontal members 58 and 59 defining an opening 60. The vertical members 56 and 57 and horizontal members 58 and 59 may be in the form of tubes or have any other configuration. The ends of the vertical members 56 and 57 are welded to the ends of the horizontal members 58 and 59 to form a rectangular configuration. The frame assembly 14 comprises around its perimeter a back 62, a front 64, an inner face 66 facing the opening 60 and an outer face 68 facing away from the opening 60 defined by the vertical and horizontal members 56-59. The frame assembly 14 also includes four triangular members 72 welded to the vertical members 56 and 57 and horizontal members 58 and 59 at or near the back of the frame assembly 14 in the corners of the frame assembly 14 extending towards the opening 60. Each triangular member 72 defines a plurality of holes 78 for selectively receiving the threaded rods 28 as hereinafter described. The inner face of horizontal member 58 defines holes 80 and 84 for receiving a bolt in the form of an upper hinge pin 190 and a bolt in the form of an upper latch pin 94 of the door assembly 16, respectively. The inner face of horizontal member 59 defines holes 82 and 86 to receive a bolt in the form of a lower hinge pin 192 and a bolt in the form of a lower latch pin 96 of the door assembly, respectively. The inner face of vertical member 56 defines a hole 174 to receive a bolt in the form of a slide bolt 194 of the mechanical locking system 40.

Although the illustrated frame assembly 14 comprises two vertical members 56 and 57 and two horizontal members 58 and 59 and has a generally rectangular configuration to complement the configuration of a conventional door opening, the frame assembly 14 may comprise any other number of members and have any other suitable configuration to complement or otherwise substantially enclose any door opening of other opening in accordance with other embodiments of the present disclosure. The frame assembly 14 and each of its components may have any other suitable construction and configuration in accordance with other embodiments of the present disclosure.

In the illustrated embodiment, each of the vertical and horizontal members 56-59 of the frame assembly 14 comprises a 2"×3" 16-gage steel tube. The illustrated embodiment of the frame assembly 14 may also include one or more strips of steel of varying lengths and thickness welded to the vertical and horizontal members 56-59 intended to cover openings that can be otherwise could be used to gain access for prying, and to otherwise add to the integrity of the assembly 10. The frame assembly 14 may be powder coated with an anti-corrosive, UV resistant coating prior to final assembly.

The illustrated door assembly 16 comprises the door 18 having a front 102 and a back 104, and a framework comprising six 1"×1½" tubes 106, 108, 109, 110, 111 and 112 welded to the back of the door. Four of the six tubes 106, 108, 110 and 112 are welded to the back 104 of the door 18 around the perimeter of the door, and the other two tubes 109 and 111 extend across the width of the back of the door. The door assembly 16 also includes a tube 172 welded to the back of the door 18 for securing the mechanical locking system 40. The door 18 may be in the form of any suitable metal sheet, such as, for example, a 16-gage steel treadplate. The illustrated door 18 has a rectangular configuration and is hingedly secured to the frame assembly 14 so that it is pivotable between the closed position and an open position by the upper and lower hinge pins 190 and 192 which are received by holes 84 and 82 of the frame assembly, respectively. The upper and lower hinge pins 190 and 192 may be in the form of retractable hinge bolts or the like, and may include any suitable hardware. Although the illustrated door 18 has a generally rectangular configuration to complement the configuration of a conventional door opening, the door may have any other suitable configuration to complement or otherwise substantially enclose any door opening of other opening in accordance with other embodiments of the present disclosure.

The door assembly 16 also includes three back panels, namely, center panel 117, top panel 118 and lower panel 119 comprising metal sheets secured to the framework opposite the door 18 to limit access to the back 104 of the door and to the mechanical locking system 40. A pair of handles 170 are secured to tubes 109 and 111. Additionally, a bolt in the form of an anti-pry pin 178 is welded to tube 110 receivable in hole 174 defined by vertical member 57 along the side of the frame assembly for securing to the frame assembly 14. A hole 210 is defined by center panel 117 to receive a portion of the mechanical locking system 40 and to allow access thereto. The door assembly 16 and each of its components may have any other suitable construction and configuration in accordance with other embodiments of the present disclosure.

The door 18 defines an access hole (not shown) to access from the front 102 of the door the mechanical locking system 40 by a key wrench or the like, and the door assembly 16 further includes a lock shroud 122 welded to the front 102 of the door disposed about the access hole to limit access to the access hole. The lock shroud 122 comprises four metal walls 124 defining a bore 126, and a face plate 128 partially enclosing the bore defining a hole 120 which aligns with the access hole of the door 18 to provide access to the mechanical locking system 40 by the key wrench. The lock shroud 122 is intended to limit access to the mechanical locking system 40 by a tool that can be used to try to pry at the lock. The bore 126 receives the manual lock 42. The door assembly 16 may be powder coated with an anti-corrosive, UV resistant coating prior to final assay.

The illustrated installation bars 26 comprise a long formed steel extrusion comprising an elongated securing member 130, a pair of elongated walls 132 interconnected with and disposed about the elongated securing member, a pair of elongated flanges 134 interconnected with and disposed about the elongated walls, and a pair of elongated radius portions 136 interconnecting the walls 132 and flanges 134. The elongated securing member 130 defines a series of spaced elongated slots 140 spaced along its length for aligning with the holes 78 of the triangular members 72. Each elongated wall 132 extends at an angle relative to the elongated mounting member in the range of about 30 degrees. Each elongated flange 134 extends outward from a respective elongated wall 50 at an angle of about 90 degrees. The elongated radius portions 136 are configured to engage the wall 50 inside the house when the door is secured to the wall 50 inside the house. The elongated radius portions and the elongated walls 50, 132 and flanges 134 provide rigidity along the length of the installation bar 26. In accordance with other embodiments of the present disclosure, installation bars 26 can instead be inverted such that the securing members 130 engage the wall 50 inside the house.

The installation bar 26 may be about 48" or otherwise in the range of 30"-60" long or may be any other length depending upon the size of door opening 12, such that the installation bar extends across a dimension of the door opening and can be secured to the wall 50. The installation bars 26 may be formed steel parts and may, for example, be fabricated from 16-gage pre-galvanized steel sheets or any other suitable steel or other material. The blank sizes may be punched in a turret press and then formed in a brake press.

Threaded rods 28 and nuts 30 and washers may be used to secure the installation bars 26 to the frame assembly 14. With the frame assembly 14 and the door assembly 16 positioned on the outside of the wall 50 of the house and the installation bars 26 on the inside of the wall 50 of the house, the installation bars 26 are moved towards the frame and door to engage the wall 50 therebetween by manually moving the installation bar 26 towards the frame assembly 14 and door assembly 16, by rotating the nuts 30 relative to the threaded rods 28 manually, by a hand tool or the like, or by any other suitable means.

The threaded rods 28 may be 24" in length or may be of any other suitable size. The nuts 30 may be in the form tamper proof nuts comprising round, angled faces with symmetrical facets in the X and Y planes. Depending upon the application, a special driver may be needed to interface and fasten and unfasten the nuts 30. The tamper proof nuts are sized to threadingly engage threaded rods 28. The nuts 30 may be any other type of nut, hardware or securing structure in accordance with other embodiments of the present disclosure. The engaging means may include any other suitable fasteners or other suitable components and structure in accordance with other embodiments of the present disclosure.

The illustrated pads 38 are configured to be disposed between the wall 50 of the house and the installation bars 26 that engage the inside of the wall of the house to prevent or minimize damage to the inside of the wall that otherwise may be caused by the installation bars 26. The illustrated pads 38 have a generally rectangular configuration and may be constructed of high durometer rubber. The illustrated pads 38 may have a dimension of 2"×4"×¼". The pads 38 may have any other suitable configuration and size and may be constructed of any other suitable rubber or non-rubber material in accordance with other embodiments of the present disclosure. The pads 38 may be omitted in accordance with embodiments of the present disclosure.

The illustrated mechanical locking system 40 comprises a modular locking system including a cam 180 secured to the tubes 109 and 172 on the back of the door by mounting plate 182 and its flanges 184 and fasteners, slide bolt 194, an upper wire 196 that connects the upper latch pin 94 to the cam 180, a lower wire 197 that attaches the lower latch pin 96 to cam 180, and a side latch pin spring assembly 198. The mechanical locking system also includes a machined lockport 103 disposed outside the door 18 to reduce access to the mechanical locking system. The upper hinge pin 190 is received by hole 84 defined by horizontal member 58. The lower hinge pin 192 is received by hole 82 defined by horizontal member 59. The slide bolt 194 is received by hole 176 defined by vertical member 56.

The mechanical locking system 40 is configured to selectively lock the door 18 to the frame assembly 14 in the closed position and to unlock the door so that, absent any other lock or obstruction, it can pivot to the open position. Additionally, the mechanical locking system 40 can be locked and unlocked from the inside which can be used, for example, to provide egress in the event of an emergency or to allow workers to work safely within the building with all doors locked.

The door 18 of the door assembly in accordance with an illustrated embodiment of the present disclosure may be opened and closed as follows. To unlock the door 18 from outside of the building, the lock 42 is first unlocked from the lockport 103 and removed from underneath shroud 122. A key wrench or the like is inserted through hole 120 of faceplate 128 to engage the mechanical locking system 40. The key wrench is rotated counterclockwise 90 degrees counterclockwise to retract upper latch pin 94 from upper latch hole 84, lower latch pin 96 from lower latch hole 86, and slide bolt 194 from slide bolt hole 176. The door 18 may then be pulled or otherwise moved to the open position. To lock the door 18 from the outside, the door is pushed or otherwise moved to the closed position and the key wrench is inserted through hole 120 of faceplate 128 to engage a latch of the mechanical locking system 40. The key wrench is rotated 90 degrees counterclockwise to retract upper latch pin 94 from upper latch hole 84, lower latch pin 96 from lower latch hole 86, and slide bolt 194 from slide bolt hole 176. Still further, the mechanical locking system may be unlocked from inside the building even when the lock 42 is locked to the lockport 103 and is in the locked position as follows. The cam tube 212 is engaged with the key wrench or the like and turned 90 degrees inserted through the holes defined by the cam tube to retract upper latch pin 94 from upper latch hole 84, lower latch pin 96 from lower latch hole 86, and slide bolt 194 from slide bolt hole 176 to unlock the mechanical locking system 40. The cam tube 212 can be turned back to lock the mechanical locking system 40.

The mechanical locking system 40 may be constructed of any suitable components that may be fabricated from pre-galvinized sheet steel or commercially post plated with zinc or the like under a hexivalent chromium. The mechanical locking system 40 may be constructed, for example, by lock hardware available from EMKA, which is an international company headquartered in the UK.

The manual lock 42 may be a standard combination lock disposed on the face of the door 18 lockable from the front 102 of the door 18 to hardware associated with the mechanical locking system. The manual lock 42 can be locked to lock the mechanical locking system from the front 102 of the door 18 and can be unlocked to unlock from the mechanical locking system 40 so the mechanical locking system can then be activated from the outside of the door.

The mechanical locking system 40 and manual lock 42 may be any other type of lock, may have more or less features or may be omitted in accordance with other embodiments of the present disclosure. In addition, the mechanical locking system 40 may comprise more or less than two locks or be of any other suitable structure, design or configuration in accordance with other embodiments of the present disclosure.

The assembly 10 can be secured over the door opening 12 in any suitable manner such as, for example, as follows: The frame assembly 14 and the door assembly 16 are pivotally secured together and are placed substantially over the door opening 12 with the back of the frame assembly 14 engaging the outside of the wall 50. The threaded rods 28 are inserted into one of the holes 78 of each of the triangular members 72. One of the installation bars 26 is placed over two of the threaded rods 28 to extend horizontally across the opening on the inside of the wall 50. The frame assembly 14 is held against the wall 50 from the outside. The plurality of slots 140 of the installation bar 26 and the plurality of holes 78 of the triangular members 72 provide alternative positioning for the threaded rods 28. The tamper proof nuts 30 are fastened to the threaded rods 28 on the opposite side of the triangular members 72 and tightened to engage the installation bars 26 with the structure on the inside of the building and to engage the frame with the wall 50 on the outside of the house. The pads 38 may or may not be included. This process is repeated at the bottom of the frame assembly 14 with the other installation bar. The door is then locked to the closed position.

The assembly 10 in accordance with the present disclosure can be used to securely enclose a door of a house as illustrated in FIG. 1. The assembly 10 may also be used to securely enclose window or other openings of the house depending upon the structure surrounding the opening. Further the assembly 10 can be used to securely enclose a door or window opening or other opening of any other building, including for example, any type of home, dwelling, town home, apartment, high rises, etc. and any type of commercial or other building, including stores, offices, factories, high rises, etc.

The assembly 10 of the present disclosure is relatively easy and cost effective to manufacture and tends to be extremely reliable in protecting entry into a building. The assembly 10 can be installed to the wall 50 or other structure of the house or other building quickly and efficiently. The assembly 10 also does not damage the structure and also can be quickly and efficiently removed for re-use. The assembly 10 is also readily removable and readily reusable with other openings.

The assembly 10 provides improved security because, among other reasons, it provides six locking points, namely, upper and lower latch pins 94 and 96, the slide bolt 194, the upper and lower hinge pins 190 and 192 and the anti pry pin 178. Other than the lock access point within the bore 126 of the shroud 122, there is no hardware outside the house. Additionally, when installed, the doors 18 are aesthetically pleasing, especially as compared to wooden window boards that are commonly used in an effort to secure door or window openings.

The present disclosure also includes a method for installing the door 18 to the wall 50 or other structure of a house or other building to securely enclose the door opening 12 or other opening defined by the structure in accordance with the disclosure set forth above. For example, the method may include positioning on one side of the wall 50 (e.g. the outside) the frame assembly 14 and the door assembly 16; securing one or both installation bars 26 to the frame assembly with the threaded rods 28 received by one of the slots 140 of the installation bar 26 and one of the holes 78 of the frame assembly so that the door is on the one side of the wall and the installation bar 26 is on an other side of the wall (e.g., the inside); moving the one or more installation bars 26 toward the frame assembly until the frame assembly engages the one side of the wall and installation bar 26 engages the other side of the wall and the wall is engaged by and between the frame assembly and the installation bar to substantially enclose the opening; and locking the door to the frame to secure the door in the closed position. The locking may employ one or both of the locks described above or one or more of any other suitable locks. The method may include securing the installation bar 26 to the frame as described above or in any other manner.

The assembly 10 in accordance with other embodiments of the present disclosure may also include extenders (not shown) that can be secured to the top, bottom or side of the frame assembly that may come in sizes of 6", 9", 12", 15", and 18" or any other suitable sizes. The extenders may be secured to any of the vertical and horizontal members 56-59 to extend the length or width of the assembly to fit any opening or to be secured over windows or decorative structure disposed about the opening.

While embodiments have been illustrated and described in the drawings and foregoing description, such illustrations and descriptions are considered exemplary and not restrictive in character, it being understood that only illustrative embodiments have been shown and described and that all changes and modifications that come within the spirit of the invention are desired to be protected. There are a plurality of advantages of the present disclosure arising from various features set forth in the description. It will be noted that alternative embodiments of the disclosure may not include all of the features described yet still benefit from at least some of the advantages of such features. Those of ordinary skill in the art may readily devise their own implementations of the disclosure and associated methods, without undue experimentation, that incorporate one or more of the features of the disclosure and fall within the spirit and scope of the present disclosure.

We claim:

1. An assembly for securely enclosing a door opening or window opening defined by a structure of a building comprising:

a frame sized to be disposed to substantially surround the opening and engage one side of the structure;

a panel sized to substantially cover the opening, the panel having a front and a back, the panel being pivotally secured to the frame and pivotable between an open position and a closed position substantially covering the opening;

at least one installation bar to secure the frame to the structure such that the frame and the panel are disposed substantially on one side of the structure and the frame engages the one side of the structure, and the installation bar is disposed substantially on an other side of the structure and engages the other side of the structure; and locking means for selectively locking the panel to the frame in the closed position and unlocking the panel so that it can be pivoted to the open position when the installation bar is secured to the frame.

2. The assembly of claim 1 further comprising a plurality of latch bolts engaged with the locking means, the latch bolts activatable by the locking means to selectively lock the panel to the frame in the closed position and unlock the panel so that it can be pivoted to the open position.

3. The assembly of claim 2 further comprising a plurality of other bolts securing the panel to the frame.

4. The assembly of claim 2 wherein the locking means comprises a cam and a plurality of wires, each wire engaging the cam and a respective latch bolt.

5. The assembly of claim 4 wherein the plurality of latch bolts includes an upper latch pin and a lower latch pin.

6. The assembly of claim 2 wherein the locking means further comprises a manual lock securable to the front of the panel and a mechanical locking system, the plurality of latch bolts engaged with the mechanical locking system.

7. The assembly of claim 6 wherein the mechanical locking system is activatable from one side of the structure and from the other side of the structure to selectively lock the panel to the frame in the closed position and unlock the panel so that it can be pivoted to the open position.

8. The assembly of claim 6 further comprising a shroud disposed on the front of the panel defining a bore, the manual lock received by the bore.

9. The assembly of claim 8 wherein the mechanical locking system comprises a lockport disposed on the front of the panel within the bore.

10. The assembly of claim 1 further comprising at least six bolts securing the door to the frame to selectively permit pivoting of the panel between the open and closed positions and locking of the panel to the frame in the closed position.

11. The assembly of claim 10 wherein at least two of the bolts comprise latch pins engaged with the locking means to selectively lock the panel to the frame in the closed position and unlock the panel so that it can be pivoted to the open position and at least two of the bolts comprise hinge pins to permit pivoting of the panel.

12. The assembly of claim 1 wherein the frame defines a pair of holes and further comprising an upper hinge pin associated with the panel and receivable by one of the holes of the frame and a lower hinge pin associated with the panel and receivable by the other of the holes of the frame for pivotally securing the panel to the frame.

13. The assembly of claim 12 further including a strip secured on the front of the panel to prevent access to at least one of the upper and lower hinge pins from the one side of the structure.

14. The assembly of claim 12 further including a pair of strips secured on the front of the panel to prevent access to the upper and lower hinge pins from the one side of the structure.

15. The assembly of claim 1 wherein the frame defines a plurality of holes and further comprises an upper hinge pin associated with the panel and receivable by a respective one of the holes of the frame, a lower hinge pin associated with the panel and receivable by a respective one of the holes of the frame for pivotally securing the panel to the frame, an upper latch pin associated with the panel and receivable by a respective one of the holes of the frame, a lower latch pin associated with the panel and receivable by a respective one of the holes of the frame, a slide bolt of the locking means receivable by a respective one of the holes of the frame for locking the panel to the frame, and an anti-pry pin associated with the panel and receivable by a respective one of the holes of the frame for securing the panel to the frame.

16. The assembly of claim 1 wherein the frame defines a plurality of holes and the installation bar defines a plurality of slots and further comprising a plurality of fasteners, each fastener received within a respective one of the holes of the frame and a respective one of the slots of the installation bar to secure the frame to the structure.

17. The assembly of claim 1 wherein the locking means comprises a plurality of latch bolts and a mechanical locking system disposed on the back of the panel for selectively moving the latch bolts to a locked position to lock the panel to the frame in the closed position and to an unlocked position, the mechanical locking system activatable from both sides of the structure.

18. The assembly of claim 1 wherein the locking means is activatable from the one side of the structure and from the other side of the structure.

19. The assembly of claim 1 further comprising a plurality of pads to be disposed between the installation bar and the structure when the installation bar engages the structure.

20. An assembly for securely enclosing a door opening or window opening defined by a structure of a building comprising:

a frame assembly sized to be disposed to substantially surround the opening and engage one side of the structure, the frame assembly defining a plurality of holes;

a door assembly including a door sized to substantially cover the opening, the door having a front and a back, the door assembly including a pair of hinges pivotally securing the door to the frame assembly so that the door is pivotable between an open position and a closed position substantially covering the opening;

a plurality of fasteners;

a pair of installation bars engageable with the frame assembly to secure the frame assembly to the structure such that the frame assembly and the door are disposed substantially on the one side of the structure and the frame assembly engages the one side of the structure, and the installation bars are disposed substantially on an other side of the structure and engages the other side of the structure, each installation bar comprising a plurality of slots, each fastener received by one of the holes defined by the frame assembly and one of the slots defined by the installation bar to engage the installation bar and the frame assembly and to secure the frame assembly to the structure; and a plurality of latch bolts and a mechanical locking system for selectively moving the latch bolts to lock the door to the frame in the closed position and to retract the latch bolts to unlock the door enabling pivoting of the door to the open position while the installation bars remain secured to the frame assembly.

21. A method for installing a panel to a structure of a building to securely enclose a door opening or window opening defined by the structure of a building comprising:

positioning on one side of the structure a frame sized to substantially surround the opening and a door pivotally secured to the frame and pivotable between an open position and a closed position;

securing at least one installation bar to the frame with a rod received by a slot defined by the installation bar and a hole defined by the frame so that the door is on the one side of the structure and the installation bar is on an other side of the structure;

moving the installation bar toward the frame until the frame engages the one side of the structure and installation bar engages the other side of the structure and the structure is engaged by and between the frame and the installation bar to substantially enclose the opening; and selectively locking the door to the frame to secure the door in the closed position, and unlocking the door to permit pivoting of the door relative to the frame when the installation bar is secured to the frame.

22. The method of claim 21 further including securing an other installation bar to the frame with an other rod received by a slot of the other installation bar and an other hole of the frame so that the door is on the one side of the structure and the other installation bar is on the other side of the structure; and moving the other installation bar toward the frame until the structure is engaged by and between the frame and the other installation bar to substantially enclose the opening.

23. The method of claim 21 wherein the locking includes activating a first lock disposed on a back of the panel, the first lock selectively activatable to a locked position and an unlocked position.

24. The method of claim 23 wherein the locking includes activating a second lock on a front of the panel, the second lock selectively activatable to lock and unlock the first lock.

25. The method of claim 21 wherein further including disposing a plurality of pads between the installation bar and the other side of the structure.

* * * * *